US008708066B2

(12) United States Patent
Orban et al.

(10) Patent No.: US 8,708,066 B2
(45) Date of Patent: Apr. 29, 2014

(54) DUAL BHA DRILLING SYSTEM

(75) Inventors: Jacques Orban, Cheltenham (GB); Sami Iskander, London (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 832 days.

(21) Appl. No.: 12/674,702

(22) PCT Filed: Aug. 30, 2007

(86) PCT No.: PCT/RU2007/000473
§ 371 (c)(1),
(2), (4) Date: Nov. 18, 2010

(87) PCT Pub. No.: WO2009/028979
PCT Pub. Date: Mar. 5, 2009

(65) Prior Publication Data
US 2011/0088951 A1 Apr. 21, 2011

(51) Int. Cl.
*E21B 17/00* (2006.01)

(52) U.S. Cl.
USPC ..... 175/321; 175/92; 175/258

(58) Field of Classification Search
USPC ..... 175/78, 92, 94, 104, 258, 262, 263, 175/267, 82, 73, 321
See application file for complete search history.

(56) References Cited

U.S. PATENT DOCUMENTS

| | | | | |
|---|---|---|---|---|
| 1,804,819 | A * | 5/1931 | Spencer, Jr. et al. | 175/81 |
| 2,500,785 | A * | 3/1950 | Armais | 175/78 |
| 2,852,230 | A * | 9/1958 | Garrison | 175/58 |
| 3,150,727 | A * | 9/1964 | Garrison | 175/78 |
| 4,007,797 | A * | 2/1977 | Jeter | 175/26 |
| 4,527,639 | A * | 7/1985 | Dickinson et al. | 175/61 |
| 4,613,002 | A * | 9/1986 | Pittman et al. | 175/107 |
| 5,394,950 | A * | 3/1995 | Gardes | 175/45 |
| 5,979,570 | A * | 11/1999 | McLoughlin et al. | 175/24 |
| 6,213,226 | B1 * | 4/2001 | Eppink et al. | 175/61 |
| 6,318,480 | B1 * | 11/2001 | Hearn | 175/61 |
| 7,946,360 | B2 | 5/2011 | Orban et al. | |
| 2008/0277166 | A1 | 11/2008 | Orban et al. | |

FOREIGN PATENT DOCUMENTS

| | | |
|---|---|---|
| EP | 1247936 | 10/2002 |
| EP | 1559864 B1 | 6/2006 |
| JP | 8-021180 | 4/1989 |
| JP | 64-090394 | 1/1996 |
| RU | 1789640 A1 | 1/1993 |
| RU | 2064041 C1 | 7/1996 |
| SU | 0732519 | 5/1980 |
| SU | 1617137 | 12/1990 |

(Continued)

*Primary Examiner* — Daniel P Stephenson
*Assistant Examiner* — Ronald Runyan
(74) *Attorney, Agent, or Firm* — Chadwick A. Sullivan; Brigitte Echols

(57) ABSTRACT

A drilling apparatus including a drill collar forming part of a primary drilling assembly and having an outward opening groove in the side thereof, and a secondary drilling assembly. The secondary drilling assembly includes a tubular drill string connected at one end to the drill collar, a drilling motor mounted in the drill string, and a drill bit mounted at the other end of the drill string and connected to the drilling motor. The secondary drilling assembly is mounted in the drill collar so as to be movable between a first position in which the drill bit is seated in the groove, and a second position in which the bit projects laterally from the groove in the side of the drill collar.

39 Claims, 19 Drawing Sheets

(56) References Cited

FOREIGN PATENT DOCUMENTS

| | | | |
|---|---|---|---|
| SU | 1693225 | A1 | 11/1991 |
| WO | 91/19075 | | 12/1991 |
| WO | 2004011766 | A1 | 2/2004 |
| WO | 2004/072437 | | 8/2004 |
| WO | 2004072437 | A1 | 8/2004 |
| WO | 2009028979 | A1 | 3/2009 |

* cited by examiner

DUAL BHA DRILLING SYSTEM

This invention relates to apparatus and methods useful for drilling lateral boreholes into a formation surrounding a main borehole.

BACKGROUND ART

Multi laterals (multiple smaller boreholes extending from a main borehole) have been drilled in a number of locations in recent years. The main motivation for this is to improve the contact with the reservoir, while minimizing the total drilling cost. Their use can also be motivated by limited template availability in off-shore platforms. In most cases, drilling of multi laterals requires complex operations with multiple trips consuming a lot of rig time. The completion of the lateral is also a complex operation: the junction to the parent well is a key element that defines the quality of the lateral and the method to control the production.

Several techniques have been developed recently to drill small laterals faster with less support from a drilling rig. Several methods have been proposed to drill laterals from a system operated via a wireline cable. Based on such methods, the lateral can be drilled without a drill string or coil-tubing as a link to surface. Examples of such techniques can be found in EP 1 559 864, WO2004072437 and WO2004011766. Multiple drilling tools are also known for drilling extended perforations (typically 1 meter long by a few centimeter diameter).

One example of a prior art system is the SCORE100 tool from Corpro Systems Ltd which operates from a main bottom hole assembly (BHA). The main BHA includes a modified drill collar which contains an integrated whipstock. When the special drill collar is positioned at the required depth in the main hole, a special small diameter BHA can be lowered inside the main drill string on a wireline cable. This small BHA contains a core barrel, a small drilling motor to rotate the core barrel, an anchor, a pushing system to generate forwards movement (penetration (ROP) and weight-on-bit (WOB)), and inflatable packer to divert the flow in to the small motor. Such a system can then anchor itself inside the collar, and push itself forward with a jacking system which generates WOB. Surface pumps generate mud flow which activates the small motor and cleans the small lateral. At the beginning of the axial displacement, the tip of the small BHA is pushed outside the main BHA by the integrated whipstock and then enters the open-hole and then the formation. The axis of the lateral is typically 3 to 6 degree inclined versus the axis of the main well. Such a system can drill a small hole up to 100 feet. Typically such a system is used for coring. The wireline cable and tool provides down-hole control of the processes especially for ROP and WOB. It also controls the anchoring of the system in the collar to ensure the crawling movement. When the lateral or the coring process is completed, the small BHA is fished with the wireline cable. The collar window is typically plugged with an aluminum ball which is drilled out by the small BHA. EP 1 247 936 describes other details of this technique.

It is an object of the invention to provide a technique which can be used for effective drilling of laterals which does not require such significant interruptions to deploy the small BHA.

DISCLOSURE OF THE INVENTION

This invention provides a drilling apparatus, comprising a drill collar forming part of a primary drilling assembly and having an outward opening groove in the side thereof; and a secondary drilling assembly, comprising:

a tubular drill string connected at one end to the drill collar;

a drilling motor mounted in the drill string;

a drill bit mounted at the other end of the drill string and connected to the drilling motor;

wherein the secondary drilling assembly is mounted in the drill collar so as to be movable between a first position in which the drill bit is seated in the groove, and a second position in which the bit projects laterally from the groove in the side of the drill collar.

In one particularly preferred embodiment of the invention the secondary drilling assembly comprises a piston slidably mounted in the drill collar, the tubular drill string being connected at one end to the piston and extending inside the drill collar, such that during movement between the first position and the second position, the piston is advanced in the drill collar.

Preferably the groove has an inclined lower end sloping up to the outer surface of the drill collar. The groove can be referenced to the tool face of a drilling tool connected to the drill collar such that orienting the tool face in a particular direction serves to orient the groove in a corresponding manner. The drill collar can have a sliding shutter that is moveable between a first position in which the groove is covered, and a second position in which the groove is open. The groove can also comprise a sliding seal through which the drill string projects when the secondary drilling assembly is moved into its second position.

The apparatus can also further comprise a retraction system for moving the secondary drilling assembly from the second position to the first position.

A transmission shaft is preferably provided, extending through the drill string to connect the drill bit to the drilling motor. The drill bit can comprise a bearing housing, possibly a bent housing, including the connection between the drill bit and the transmission shaft. The bearing housing can also contain measurement devices such as LWD- or MWD-like sensors.

The piston typically further comprises a pressure relief valve to allow fluid to pass along the drill collar without moving the piston.

The drilling motor can comprise a regulator that controls the opening of the bypass according to motor speed. It is particularly preferred that the drilling motor comprises a siren including a stator connected to the piston and a rotor mounted adjacent the stator and connected to the drill bit. In this case, the rotor can be connected to the drill bit via a torsion spring. It is also preferred to provide means, for example magnets to urge the rotor into an open position relative to the stator.

A pressure detector can be provided for detecting pressure pulses created by operation of the siren and creating a signal, and a control system provided for using the signal to control operation of the secondary drilling assembly.

The piston preferably comprises a bypass to allow fluid to pass along the drill collar without moving the piston.

In one embodiment, means are provided for adjusting the angular position of the rotor and stator as the secondary drilling assembly moves towards the second position. The means can comprise a groove in the drill collar defining a cam surface along which a rotor locating key slides as the secondary drilling assembly moves.

The drill collar can include an operable clamping device that can act on the secondary drilling assembly such that operation of the device to clamp the secondary drilling assembly to the drill collar allows movement of the drill collar to move the secondary drilling assembly and operation of the device to release the secondary drilling assembly allows independent movement of the primary and secondary drilling assemblies. In one embodiment, the clamping device comprises a pair of pivoted eccentric bodies acting on the secondary drilling assembly.

It is preferred to provide means for resisting torque resulting from operation of the secondary drilling assembly. These can comprise: an elongate key on the drill string which engages in a corresponding grove in the drill collar; an extension of the drill string above the drilling motor, the extension comprising an elongate key on the drill string which engages in a corresponding grove in the drill collar; or a drill string having a non-circular section which slides through a correspondingly shaped seal.

An attachment point can be provided on the secondary drilling assembly for connection of a retrieval line to move the secondary drilling assembly from the second position to the first position.

A secondary piston bypass and valve arrangement can also be provided to direct fluid flow in the drill collar to the underside of the piston to move the secondary drilling assembly from the second position to the first position.

A drilling assembly according to another embodiment comprises a control mechanism operable to force the secondary drilling assembly out of the groove. In this case, the secondary drilling assembly can be connected to the drill collar by a hinge and the drill string can be flexible.

In an alternative embodiment, the secondary drilling assembly, comprises a crawler device located in the drill collar, the tubular drill string being connected at one end to the crawler device and extending inside the drill collar; wherein, during movement between the first position and the second position, the crawler device is advanced in the drill collar.

A drilling assembly as claimed in any preceding claim, wherein the primary drilling assembly is configured to drill a window in well casing though which the secondary drilling assembly can be advanced.

A method of drilling a borehole using a drilling apparatus as claimed in any preceding claim, comprising:

drilling a main borehole;

positioning the apparatus at a predetermined location in the main borehole;

operating the secondary drilling assembly so as to advance the drill bit away from the first position and drill laterally into the formation surrounding the main borehole and form a lateral borehole; and withdrawing the secondary drilling assembly to the first position.

The primary drilling assembly can be used to drill the main borehole.

A method can also further comprise advancing the drill collar while the secondary drilling assembly is drilling into the formation. In one case, this can comprise alternately advancing and retracting the drill collar over a short distance in the main borehole while the secondary drilling assembly is drilling into the formation.

Where the main well has been lined with casing, the method preferably comprises opening a window in the casing using the primary drilling assembly prior to operating the secondary drilling assembly to drill through the window into the formation.

This invention is based on a combination of a small BHA (secondary drilling assembly) installed inside a main BHA (primary drilling assembly). The main BHA allows drilling of a well in a substantially conventional manner. The main BHA may contain devices such as rotary steerable systems or motors, MWD and/or LWD devices, etc. The main BHA includes a special drill collar which includes the small BHA. In particular, the special collar is includes a window or groove, allowing the small BHA to move from the internal bore to the external side of the main BHA. A modified whipstock can be integrated in the window collar.

During the drilling of the lateral, the main BHA is quasi static. The small BHA includes a motor, preferably steerable, which can be pushed forward and enters in the formation. With proper steering, the small lateral can then drilled away from the main well. The drilling is normally performed in sliding mode. When the lateral drilling is finished, the small BHA is retracted inside the main BHA. Then the main BHA can restart normal activity in the main well, such as drilling deeper.

In the preferred solution, the implementation is based on a mechanical system.

The double BHA system can also be operated in cased hole. In that case, the first bit is replaced by a mill to open the window in the casing. The small BHA can then drilled the lateral without trip.

Particular modifications of the basic concept include:

the small BHA can be instrumented so that that logging can be performed away from the main well.

multiple reservoir applications can be improved and developed thanks to this double BHA.

special junctions can be implemented to ensure circulation from the main well into the lateral, while produced fluid enters the lateral and flows into the main well. This technique is particularly interesting for heavy oil applications and for special treatment of the produced fluids still the formation.

MODE(S) FOR CARRYING OUT THE INVENTION

Figure 1:
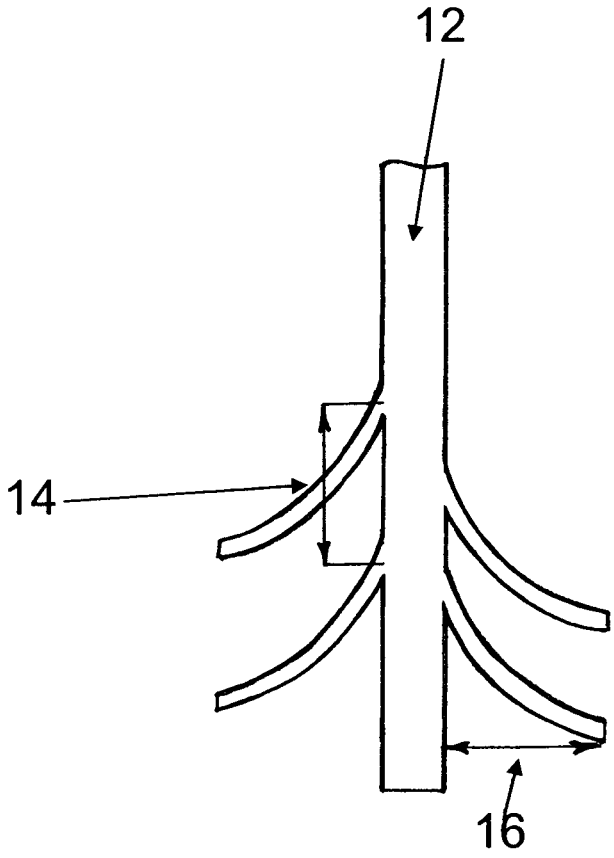
FIGS. 1 and 2 show lateral wells drilled using the present invention.

The objective of this invention is to provide a system for drilling multiple small laterals 10 from a main well 12 (see FIGS. 1 and 2) without the need for trips between successive drilling operations (of lateral and/or main well).

The length of the laterals 10 is typically in the range of 15 to 100 feet, while diameters vary from 1.5 to 3.5 inches and vertical separation 14 can be less than 1 m. Their trajectories are commonly of constant radius to reach a direction nearly perpendicular to the main well: in this case the radius of curvature of the lateral is typically from 10 to 50 feet leading to a depth of penetration 16 away from the main well 12 of up to 20 m (see FIG. 1). For other applications, the lateral trajectory can be straight (see FIG. 2) with an axis between 2 to 7 degrees 18 from the main well 12.

Figure 3:
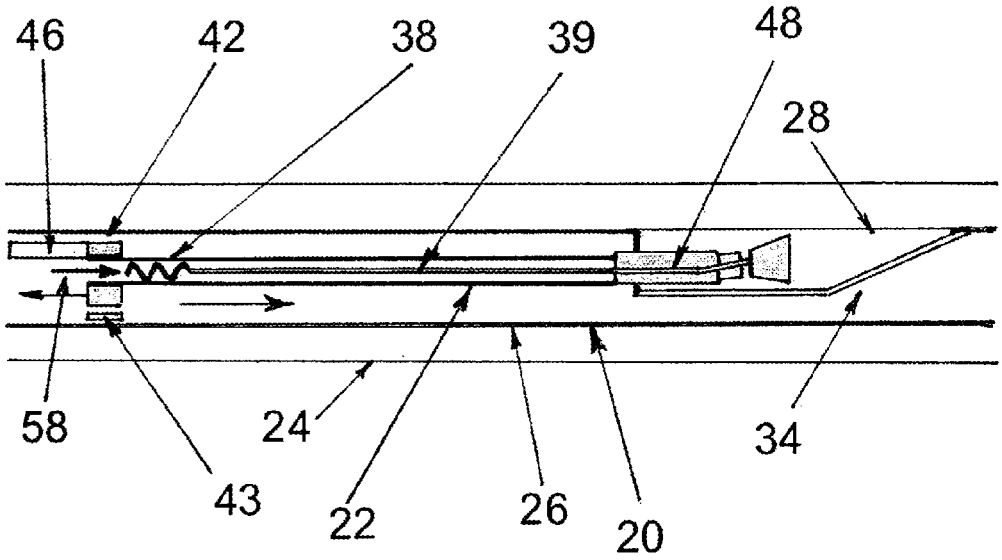
FIGS. 3 and 4 show a first embodiment of an apparatus according to the invention.

The main BHA is largely constructed from the conventional components depending on the objectives to be achieved. Starting from the bottom, the BHA obviously includes a bit. It may include a rotary steerable system or a steerable motor, stabilizers and flex joints. MWD and LWD tools can also be added if required for the drilling objectives. The small BHA system is included in a special drill collar as is shown in FIG. 3.

The dual BHA includes a main BHA 20 and small BHA 22. The main BHA 20 drills the main well 24, while the small BHA 22 drills the laterals. Some components of the dual BHA are included directly within the main BHA 20. In particular, a special collar 26 with a side window 28 to allows the small BHA 22 to move out of the main BHA 20 and enter in the open-hole 24 and the formation 30 of the side of the main well 24. This window collar 26 is equipped with an external groove 32 which is terminated at its lower end by an inclined slide (or whipstock) 34. The tool-face of the window 28 is normally referenced to the MWD tool face of the main BHA 20, to allow it to be oriented in the correct direction before the lateral drilling begins.

The small BHA 22 is a continuous system that will slide inside the main BHA 20. Its lower extremity is in the external groove 32 of the window collar 26. It passes from the inside to the outside of the main BHA 20 via an axial sliding seal 33 at the top of the external groove 32 in the window collar 26. The small BHA 22 includes from bottom up:

a drill bit 36;

a drilling motor 38 that can drive the drill bit 36 in rotation by means of an extended transmission shaft 39;

a drill string 40;

a system which can push the small BHA 22 out of the collar 26: in this embodiment it is a hydraulic piston 42 with a flow bypass 43, but a mechanical system is also possible:

a control unit 44 which allow control of the operation of the small BHA 22 (this control unit can be either mechanical, or electro-mechanical);

a system which allows the small BHA 22 to be retracted inside the main collar 26 when required: in this case a slick line tool hook 46 is provided to allow a slick line to grasp it with a fishing tool and pull it backwards (other methods are also possible as are discussed below); and a latch system (not shown) allow the small BHA 22 to be locked in the main BHA 20 when the small BHA 22 is to be inactive.

Figure 4:
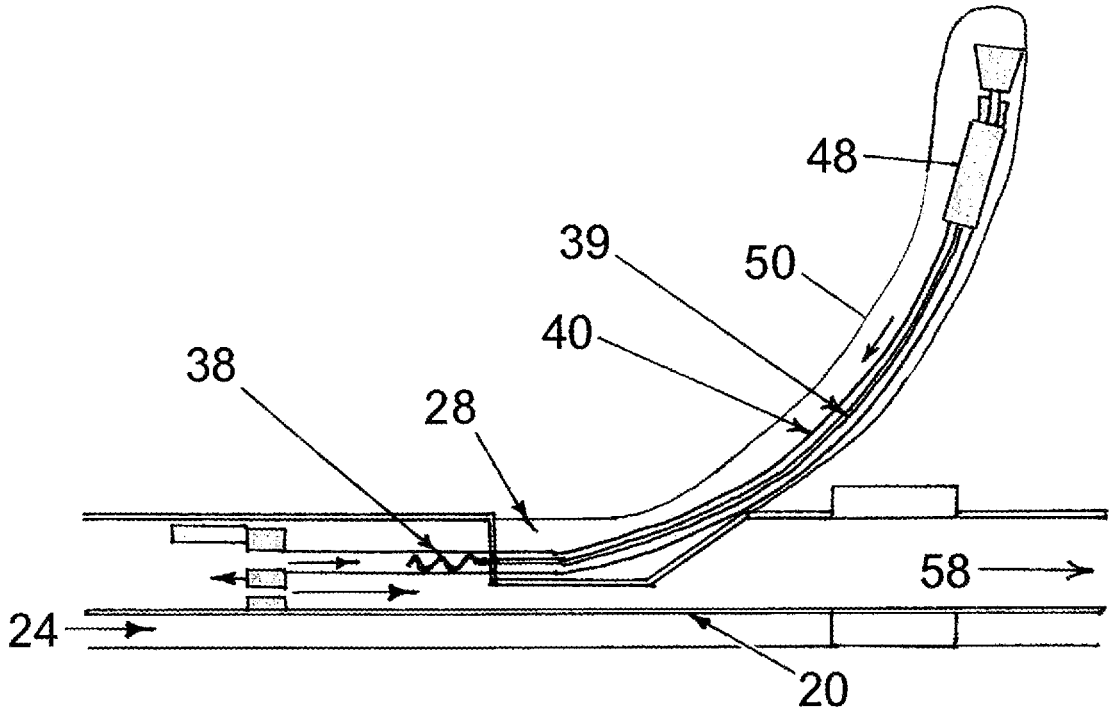

In use (see FIG. 4), as drilling fluid is pumped along the main BHA 20, the small BHA 22 is pushed forward by the sliding piston 42 as the fluid-pressure on this piston generates the WOB for the small BHA 22. The bit 36 of the small BAH 22 is initially pushed sideways by the inclined surface (or whipstock) 34. After some displacement, the front end of the small BAH 22 is in the formation 30 and act as a steerable motor in sliding mode. It then builds angle and the lateral trajectory move away from the main well 24.

The small BHA 22 contains a modified steerable motor. The bit (typically 1.5 to 3.5 inches in diameter) is attached to the bit box/bearing housing 48) similar to that of a conventional small steerable motor. Above the bearing housing 48, a bend housing is also installed so that the motor steers the lateral 50 in the required direction. With the bend housing 48 in the plane containing the main well 24, the plane of the lateral 50 will also contain the main well 24. With such a bend-housing orientation, the driller only has to worry about the azimuth of the window collar 26 when positioning the collar in the well: the system will then drill the lateral 50 in the same plane.

Above the bend-housing 48, the drill string 40 is installed to connect the motor section 38 to the shaft in the bearing housing 48. This can be up to 30 meters long (or longer). With this extension, the motor power section 38 stays inside the main BHA 20 and is not flexed in the sharp curve of the lateral 50. With such a design, the motor 38 does not suffer from the hole curvature.

Figure 5:
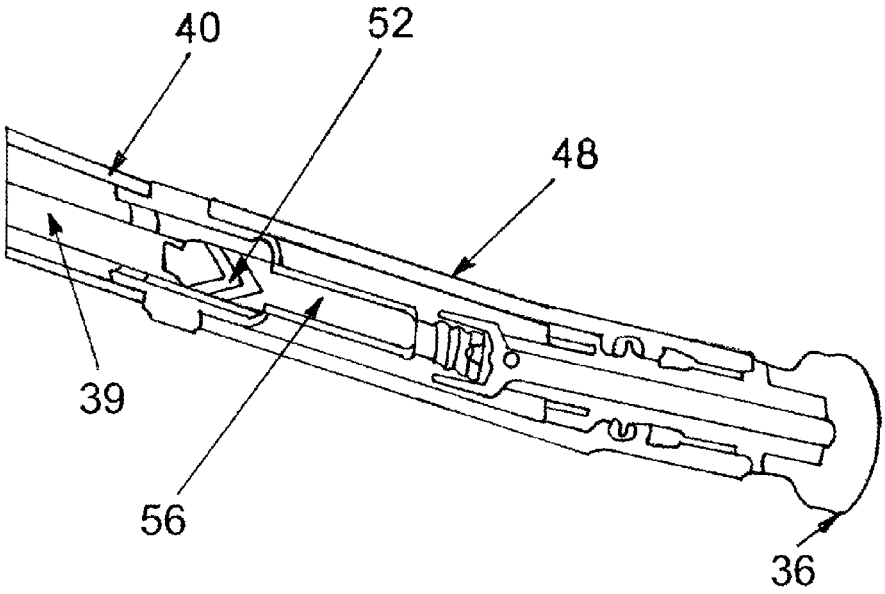
FIGS. 5 and 6 show detail of parts of the embodiment of FIGS. 3 and 4.

The extended transmission shaft 39 is flexible (laterally) to follow the hole curvature. Furthermore, it replaces the conventional universal joints between the rotor and the bit drive shaft. This shaft may be made of titanium to support bending (with associated fatigue while rotating), as well as the stress level from the drilling torque. The motor 38 also generates a downwards force (due to difference of fluid pressure across the motor 38). This force is also applied to the extended transmission shaft 39, and tends to generate buckling in the shaft which may therefore have to be supported by radial bearings (not shown) over its length. A torsional damping system 52 (see FIG. 5) may also be required to damp torsion resonance in the extended shaft 39.

To allow aggressive (tight) hole curvatures, the bearing housing 48 is relatively short. However, it may also comprise a small housing 56 to support some measurement devices if required.

With such as motor system, the lateral 50 will be drilled in sliding mode. It will have a nearly uniform build-up rate. In some case, it may be appropriate to drill the lateral 50 nearly parallel to the main well 24 (only a few degrees of deviation). In this application, a straight motor may be used (no bend in housing 48). The deviation will be achieved by the slope of the integrated whipstock 34.

The extended motor comprises the drill string 40 between the bearing housing 48 and the motor power section 38. The drill string 40 typically has a diameter of 1.2 to 2.5 inches. This does not rotate, it only transmits WOB for the bit 36; the torque is transmitted via the extended internal transmission shaft 39. This drill string 40 is flexible to pass in the curve while minimizing the contact with formation 30. In some applications, this pipe may be titanium or composite (fibre and epoxy) for high flexibility. Elliptical sections can be considered to transmit properly WOB, and ensure more lateral flexibility in the plane of curvature.

Obviously, the motor 38 and drill string 40 has to be small enough to slide inside the main collar 26. If the main BHA 20 is 6.75 inches in diameter, the drill string 40 may be 2⅜ or 2⅞ inches. Other dimensions may be appropriate.

Figure 6:
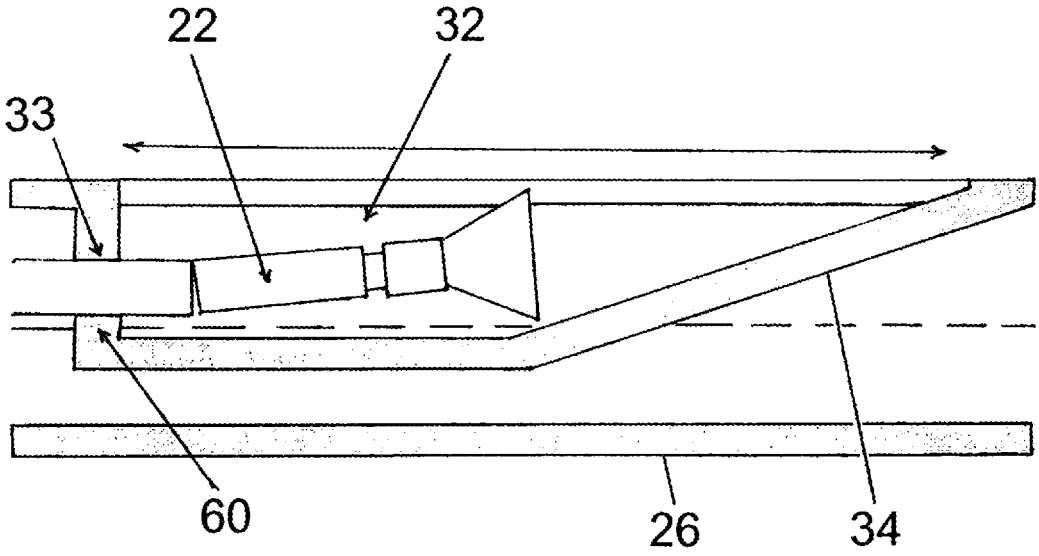

As can be seen in FIG. 6, the special drill collar 26 allows the small BHA 22 move out of the main BHA 20. This collar is equipped with an external groove 32 terminated at its bottom by the inclined surface (integrated whipstock) 34. The top of the groove is equipped with a small axial bore and sliding seal 33 to let the small BHA 22 slide through it. The bit 36, the motor bearing housing and bend housing 48 typically remain in the groove 32 when not drilling into the formation 30, while the drill string 40 slides in the sliding seal area 33 of the window collar 26. This seal 33 can be in its most simple form a tight fit hole. This ensures that the mud 58 flowing inside the collar 26 is forced downwards towards the main bit (not shown). An optional fishable plug 60 can be provided in the seal section 33.

Specific contact surfaces of the bearing section (or bend housing) 48 slide on the inclined surface 33, to push the housing 48 to the outside of the collar 26 (and the force the bit 36 to enter in the formation). This process offers the advantage of minimum wear of the guidance (slide) surface. This guidance method is also useful with a rock drilling bit, as the bit teeth will not break due to contact with the metal guidance surface.

When the small BHA 22 is fully retracted, the bit 36 is then engaged in groove 32 inside the collar 26, so that it cannot move radially. The bit 36 is and stays inside the diameter of the main collar 26. This avoids the bit 36 coming into contact with the formation wall, when the main BHA 20 is moving or rotating in the main well 24. The external collar groove 32 extends over a few meters. When the drill string 40 is engaged in the lateral 50, the main BHA 20 can move a few meters axially in the main well 24, without risk of shearing for the drill string 40.

In this concept, the WOB for the small BHA is generated via pressure applied to the sliding piston 42. This piston slides in the bore of the collar 26 and is connected to the top of the small BHA 22. The piston 42 is also equipped with a flow by-pass 43 to ensure that the fluid can still flow down the main BHA 20 while pressure is maintained on the piston 42. Depending on the design, the fluid pressure acting on the piston could act over a surface of 10 to 15 square inches. Up to 500 PSI could therefore appear across the sliding piston 42. This combination could then generate a large downwards force of up to 5000 to 7500 pounds. As this is quite large in comparison of the considered drill bit size (2.5 to 3.5 inch diameter) a lower-pressure is require in most cases.

With the design described above, it is foreseen that typically 30% of the total flow will pass through the motor 38 (while drilling the lateral 50). If the motor 38 stalls, the pressure drop across the small BHA 22 increases and the flow through the flow by-pass port 43 of the sliding piston 42 will increase: this means the pressure increases and the WOB then increases accordingly. This makes the control of the small BHA 22 potentially difficult as under stalling, the WOB is even slightly increased, blocking the bit further and maintaining the stall condition. To avoid this situation, a flow control valve can be installed in the sliding piston to ensure a reduction of WOB when motor RPM is dropping (or stalling occurs).

Figure 7:
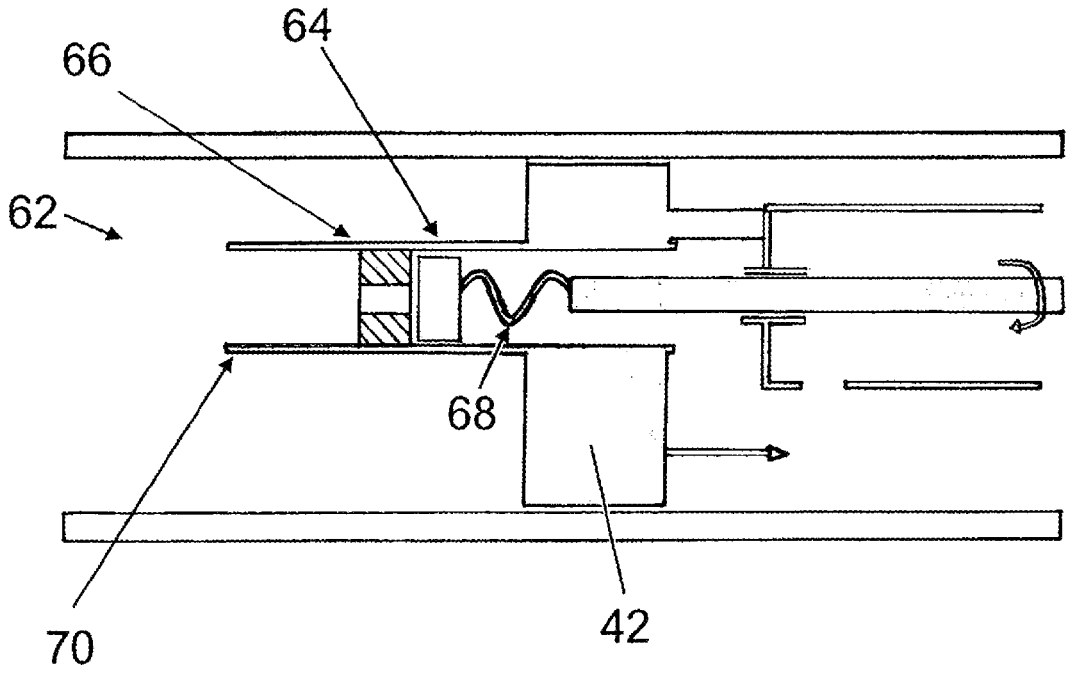
FIG. 7 shows a second embodiment of an apparatus according to the invention.
Figure 8:
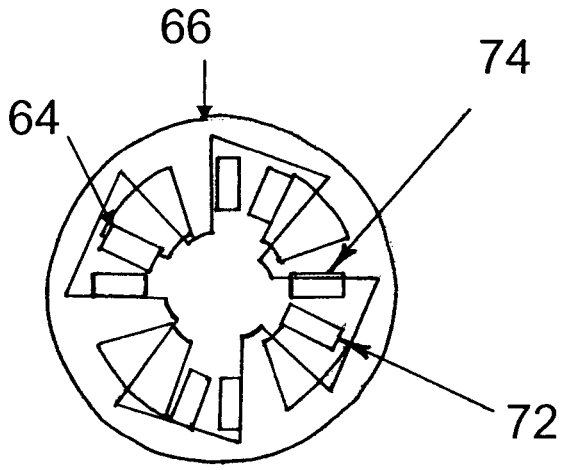
FIG. 8 shows a plan view of the siren of FIG. 7.
Figure 9:
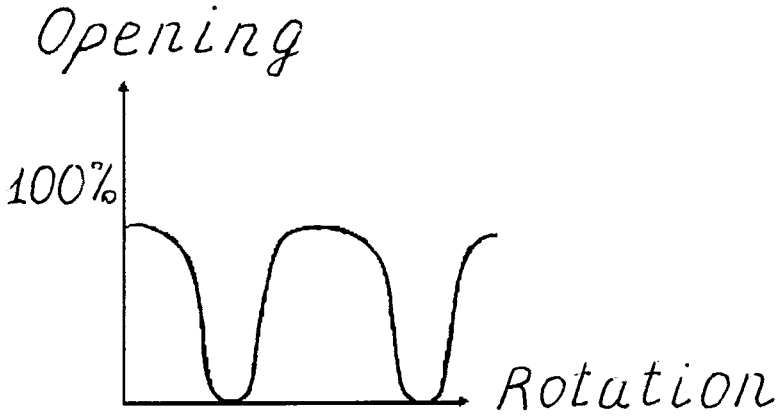
FIG. 9 shows a plot of % opening vs. rotation for the siren of FIG. 7.

FIG. 7 shows one part of a particularly preferred form of motor section for use in the present invention. The motor 38 comprises a typical Moineau-type motor used for drilling applications. The rotor of this motor (not shown) drives a rotary valve 62 comprising a rotor 64 and stator 66 similar to a siren system commonly used for MWD telemetry. This rotary valve 62 is located in a bypass 70 which is connected to the piston 42 and to which the stator 66 is fixed. It controls the pressure drop across the piston 42 of by controlling the amount of fluid flowing through the bypass 70. The pressure applied to the surface of the sliding piston 42 generates the WOB for the small BHA 22. The rotor 64 of the siren 62 is connected to the motor 38 via a torsion spring 68. Furthermore, the rotor 64 and stator 66 of the siren 62 are equipped with magnets 72, 74 (see FIG. 8) which tend to keep the siren open by urging the vanes of the rotor 64 to align with the vanes of the stator 66 rather than lie in the openings of the stator 66. When the motor 38 is rotating at constant speed, the siren rotor 64 has an unsteady rotation (see FIG. 9), as it tends to stay in the open position. In particular, when the motor 38 is not rotating, the siren 62 is open (thanks to the twisting of the coupling spring 68).

Figure 10:
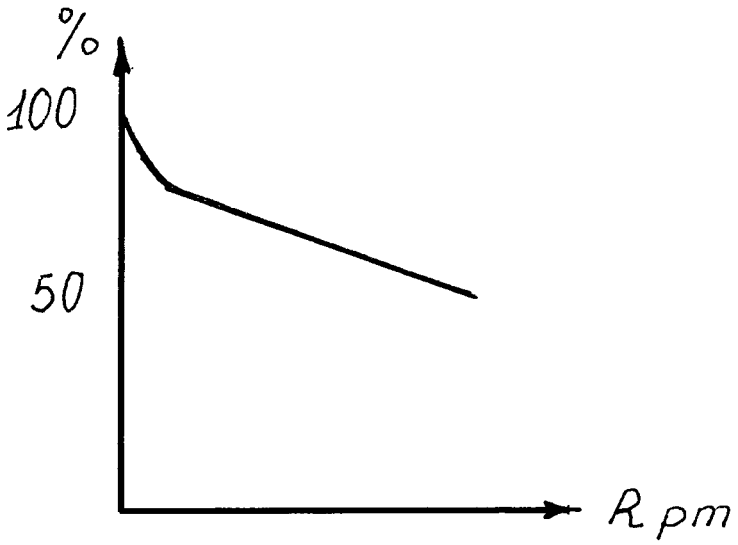
FIG. 10 shows a plot of % time-averaged opening vs. motor RPM for the siren of FIG. 7 shows.

Because of this behaviour, the time-averaged opening of the siren 62 varies from 100% when not rotating to nearly 50% at high speed (see FIG. 10). The flow switching can typically be from 10 to 75 hertz. However, higher frequency flow switching is preferred to allow easier time averaging of WOB thanks to the inertia of the small BHA.

Figure 11:
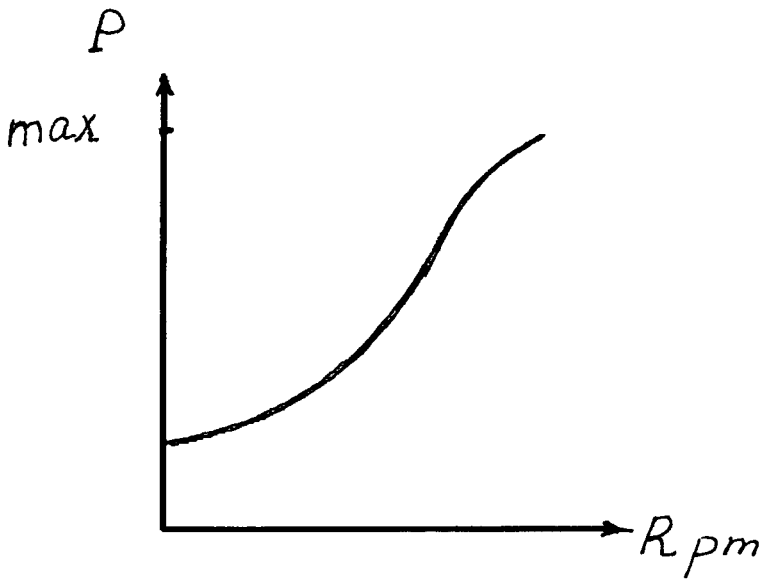
FIG. 11 shows a plot of time-averaged pressure difference (delta pressure) vs. motor RPM for the siren of FIG. 7 shows.

The "time-averaged" pressure drop across the siren 62 varies with the motor RPM, as indicated in FIG. 11. It can be adjusted by the mechanical design of the siren 62 (the stiffness of the spring 68, the mass of the rotor 64, the force of the magnets, etc.). FIG. 10 shows that lower time-averaged opening (i.e. higher motor and rotor RPM) leads to higher WOB (FIG. 11).

The effect of high WOB is to reduce the RPM of the motor 38 RPM. If the RPM decreases enough, then the siren 62 will automatically reduce WOB (FIGS. 10 and 11) so that equilibrium is found to allow the motor to stay at an appropriate RPM. If the motor is close to a stalled condition, the RPM is very low and the siren re-opens and the WOB is drastically reduced. In conclusion, the motor will have an operating point which depends on the conventional curve of the motor (RPM versus flow). RPM response will also depend on the bit characteristics as well the rock properties.

Figure 12:
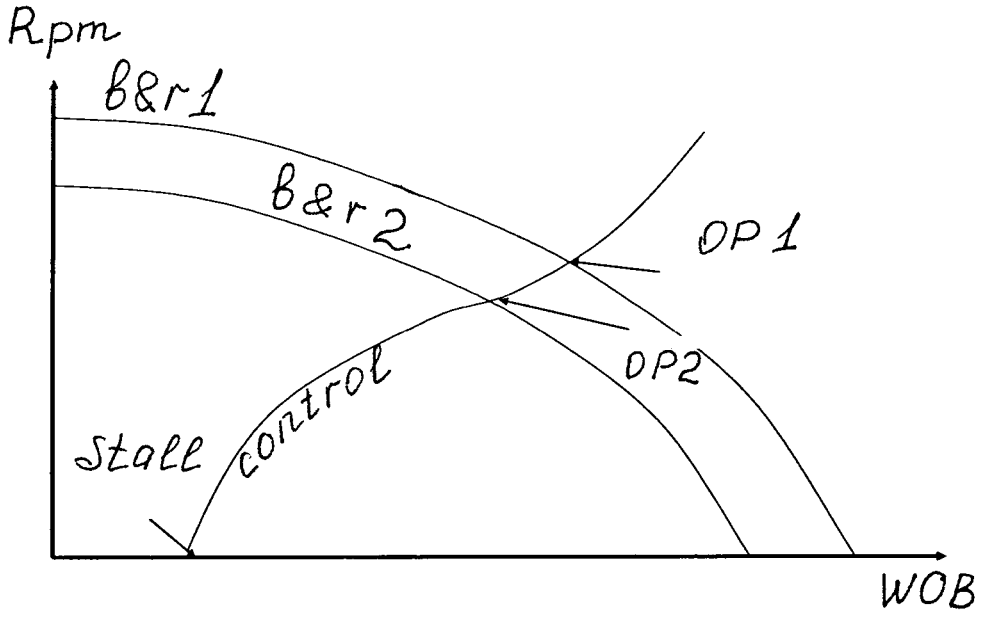
FIG. 12 shows a plot of RPM vs. WOB for different motor curves

The combination of motor curve and control function is illustrated for two cases in FIG. 12. As can be seen, the control curve shows that the WOB is still existent when RPM is zero (at stall point of the motor). This is due to the fact that the fluid pressure is still applied on the section of the sliding seal in the collar window, pushing the BHA forwards. The control function curve should be as horizontal as possible: the control surface of the siren should be large compared to the sliding seal area. Furthermore, the pressure pulse created by the siren 62 should be high compared to the pressure drop across the small BHA (small motor and small bit) 22. For example, a pressure drop in the small BHA 22 in the order of 500 PSI; a pressure pulse in the siren of 1000 PSI. The ratio of the control surface to seal area can be 2, providing a four-fold a force ratio for operation.

If the motor is blocked in the stalled position without release with the WOB control system, it is necessary to pick the small BHA 22 off-bottom to allow the motor 38 to restart as is described below.

Another approach to control is to use a centrifugal regulator. The motor 38 can be arranged to drive a centrifugal regulator from its upper end which is connected to the flow bypass port. At high RPM, the regulator closes the flow bypass port, increasing the pressure drop across the sliding piston 42 thereby increasing WOB which has the effect of decreasing RPM. The reverse effect occurs when the motor RPM reduces: the centrifugal regulator opens the valve more, reducing the pressure drop across the piston and hence the WOB. This WOB reduction allows the motor increase RPM to find its proper operating point.

Both of the proposed regulating systems are self adjusting. They require no human intervention.

WOB can also be controlled using a clamping device in the main BHA 20 to operably clamp the small BHA 22. In this configuration, the main BHA 20 pushes the small BHA 22 forwards over a typical distance of 1 or 2 meters. This is achieved by the clamping system which acts only downwards: when the main BHA 20 moves downwards, it grabs the small BHA 22; and both BHAs 20, 22 move together. After a stroke of 1 or 2 meters (typically), the large BHA 20 is moved upwards for 1 or 2 meters: the clamping system releases the small BHA 22 during this movement. The small BHA 22 stays in its depth (typically with the bit on bottom, due to fluid-pressure across the motor. When the main BHA 20 has been lifted by the proper distance (1 or 2 meters), it is then moved again downwards so that it clamps the small BHA 22 again. With this design, the main BHA 20 has to move up and down by short stokes (typically 1 or 2 meters). Every time it moves downwards, the small BHA 22 also moves downwards.

The clamping system must be deactivated by the control unit to allow the retraction of the of the small BHA 22 inside the main BHA 20 at the end of the drilling operation.

The clamping system can be made of two eccentrics (such as the contact paths of a cased hole tractor). These eccentrics preferably have even contact area with the drill string to avoid local deformation.

When drilling in sliding mode, it is important to ensure that the motor 38 operates at its proper RPM. To address this issue, the modulation of an acoustic signal in the drilling fluid by the siren can be used. The frequency of the modulated signal is directly proportional to the motor RPM. At surface, this signal is detected and its frequency is a measurement of the motor RPM. If this signal indicates that the motor is operating incorrectly, the driller can take appropriate corrective actions.

The siren used for WOB regulation may play the role of signal generator to surface or a specific siren may be installed in the total flow reaching the system or in a partial flow (such as the flow across the motor).

Figure 13:
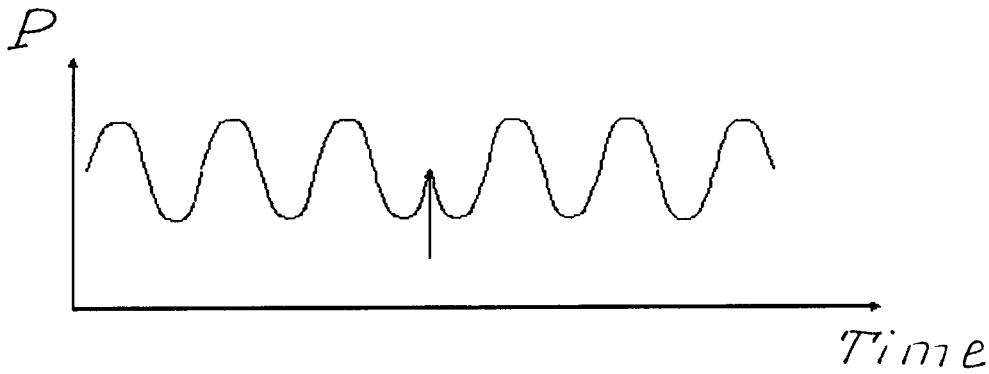
FIG. 13 shows a plot of modulated signal vs. time for a siren in a third embodiment of an apparatus according to the invention.
Figure 14:
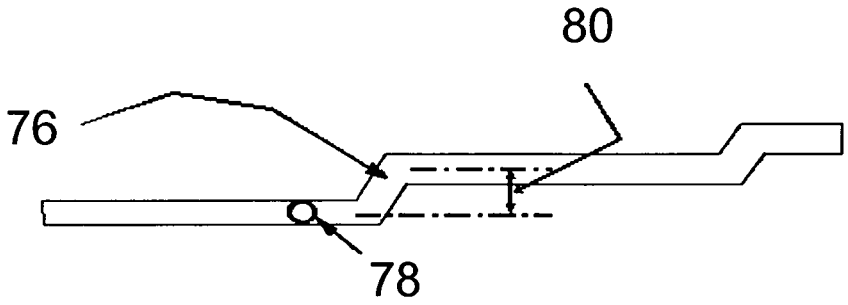
FIG. 14 shows part of the third embodiment of the apparatus according to the invention.

It is also important to determine if penetration is achieved during drilling of the lateral. Depending of the control system used, this information can be obtained. For example, if a slick-line is connected to the top of the small BHA 22 during the lateral drilling, the lateral penetration is detected via the movement of the slick-line. Another method is to change the angular position of the siren stator of WOB control system by the angle corresponding to 180 degree of signal modulation (this corresponds to half the angular distance between two adjacent vanes). This shift will appear as an abrupt signal shift X in the signal vs. time plot (FIG. 13). This angular shift can be obtained by varying the path of a groove 76 in the main collar 26 in which the reaction torque key 78 of the stator slides, the groove 76 defining a cam surface. The key groove 76 is formed of straight segments, e.g. 0.5 ft, connected by angled portions which shift the groove by the appropriate distance 80 to give the angular shift of the stator and hence the signal (FIG. 14). Thus peaks X will appear for each 0.5 ft penetration of the small BHA 22. It may be necessary to make the mechanical phase shift alternatively to the right and the left to avoid large mechanical rotation of the system.

An additional method is required to detect that the small BHA is the end of its displacement stroke. A simple method is to provide a gap between the piston and the bore in which it slides, so that the pressure drop across the piston is drastically reduced when the piston reaches the gap: this can be observed at surface. The piston can be re-engaged by lowering the main BHA by a small displacement (e.g. 1 ft) to reengage the piston in the bore and re-established the pressure drop. By successive movement, the driller can have full confirmation of the end of stoke detection.

Depending on the design, the stroke of the sliding piston may be less than one collar length (e.g. 10 m) or up to 30 m or more.

The sliding piston 42 may consist of a solid piston which slides directly in the bore of the main collar 26. It can be sealed with a rubber element such as packing or o-ring, or it can be inserted in the bore with a small clearance: this small clearance acts then as a flow choke (as there is a pressure drop in the clearance). For more flexibility, the piston can be equipped with a rubber cup which slides in the collar bore. This rubber cup can adapt to the narrower pin diameters between the collars. This system provides better sealing and potentially larger WOB as the rubber cup can adapt to large diameter bore when not in the collar pin section.

The motor 38 generates the drilling torque for the small BHA 22. There is obviously a reaction torque that must be transmitted to the main drill collar 26, while at the same time allowing axial displacement of the small BHA 22 inside the main BHA 20. Three systems are considered as particularly preferred for this:

The drill string 40 is equipped with a long key (over its length) which slides in a slot of the guidance system of the main collar 26.

A small pipe is attached above the motor 38. This pipe has a length equivalent to the drill string 40 (or maximum drillable length of the small BHA 22). This pipe moves axially with the small BHA 22 inside the bore of the main collar 26. This pipe has a key groove over its whole length. A key is attached to main the collar 26 at the position just above the motor 38 (when is it retracted in the main collar 26).

A drill string 40 of elliptical shape. This elliptical pattern slides into the equivalent shape guidance system of the main collar 26. This pattern allows torque transfer from the small BHA 22 to the main collar 26. The sealing is also possible as both ellipses are well defined.

When the small BHA 22 is fully retracted, the fluid flow driving the motor 38 has to be stopped. This is achieved by means of a sealing system at the top of the small BHA 22: when fully retracted, a sealing block sits at the top of the flow channel connected to the small BHA 22 so that no flow is possible.

It in necessary that the small BHA 22 can be retracted inside the main BHA 20. Several systems are possible for this operation.

One is based on the use of slick-line with a fishing tool. The slick-line is lowered inside the drill string: the fishing tool grabs a special hook 46 on top of the sliding piston 42 (see FIG. 3). Then the slick-line is pulled upwards: this ensures the retraction inside the main BHA 20. After full retraction, the fishing tool is released, and the slick-line is then removed from the drill string. The slick-line cab be left connected to the small BHA 22 during the whole drilling of the small lateral.

Figure 15:
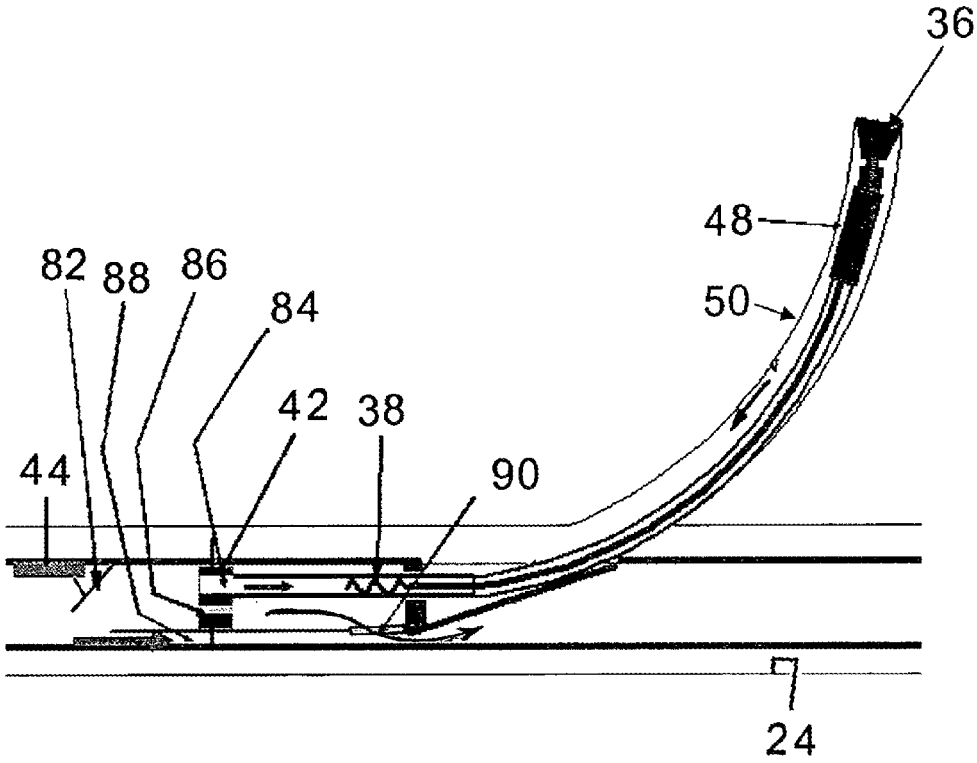
FIG. 15 shows a fourth embodiment of an apparatus according to the invention.
Figure 16:
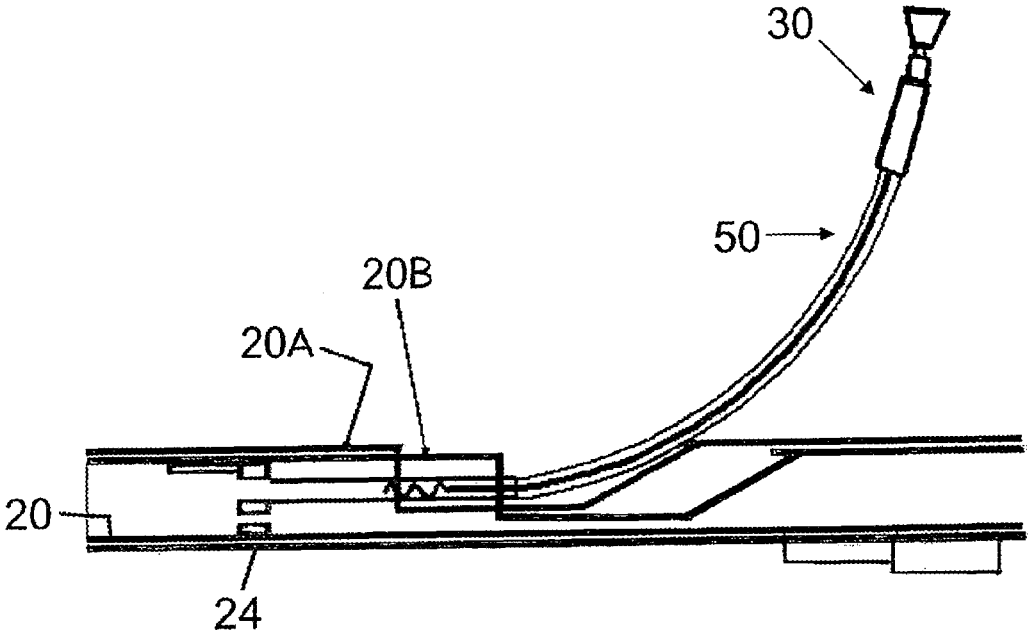
FIG. 16 shows the operation of an embodiment of the invention in accordance with a preferred method.

Another solution is to use a pressure difference in the system to generate the upwards force to retract the small BHA 22. This system is shown in FIG. 15. With this system, the flow in the nozzle of the WOB piston 42 can be reversed depending on the position of a flow flap 82. When the flow flap 82 is open, one part of the mud flows through the motor passage 84 (and drive the bit 36 in rotation). The main flow goes to the main BHA 20 via primary and secondary by-pass ports 86, 88. This flow generates a pressure differential across the WOB piston 42, which is pushed downwards (and pushes the bit 36 downwards). The flow flap 82 can be opened and closed by the control unit 44. When the flap 82 is closed, a small flow will move upwards via a by-pass connection 90. This flow then passes upwards through the secondary by-pass 88 and finally flow down the motor passage 84 to the motor 38 and bit 36; however this flow is negligible. The main flow generates generate a pressure difference across the main BHA 20. This pressure now creates an upwards force onto the sliding piston 42, so that the small BHA 22 is pulled back inside the main BHA 20.

The reversal effect can even be stronger when a dual flow flap system is used: the second part of the flow flap (not shown) allows flow through the primary by-pass 86 to be shut off. The two flaps are always in opposite positions (one open, the other closed)

Several control unit technologies can be applied in this invention. One approach is to use a slick-line to control the latch and the flow flap valve 82. At the beginning of the job, the slick-line can pull following a proper sequence to unlatch the small BHA and toggle the flow flap valve 82. At the end of the job, the same slick-line can be used to retract the small BHA 22 and toggle the flow flap valve 82 again, as well as re-latching the small BHA 22 in the main BHA 20.

Alternatively, the control unit 44 can be based on hydraulic and mechanical commands. Different approaches can be adopted:

A sliding mandrel with J-slot mechanism which uses up and down movement interlaced with rotation.

A sliding mandrel which can be compressed or not depending on whether or not the mud flow has been established first.

Rotation to insure drag on a sleeve with pad. The rotation can only be achieved if mud flow has been initiated with the proper sequence.

Hydraulic bit setting by change of flow rate. This system typically operates at the start of a flow period. Then, by passing from no flow to high flow to medium flow (or different sequence), at predetermined timings allows the system to begin start drilling the lateral or to cease drilling.

With such system, it is easy to decide if the small BHA 22 should either in the retracted and latched mode or liberated for drilling. The main advantage of a hydraulic mechanical control unit is the simplicity for design, maintenance and operation.

Electrical control systems are also possible. They could be based on bi-directional telemetry for setting and control. The electrical control system can be controlled via an electrical wireline cable. This offers full flexibility and high data rate: this can be valuable if measurements are performed while drilling the lateral.

The drilling of the lateral takes some time (from a few minutes to 1 hour). During this period, the main BHA 20 may be left in static mode. This is quite hazardous, as the risk to become stuck is not negligible. To minimize this risk, the system is designed to allow constant movement of the main BHA 20 in the main well 24. The main BHA 20 can be move up 20A and down 20B over short distance (typically in the range of a few meters). This movement is allowed thanks to the external groove 32 in the window collar 26. As soon as the small BHA 22 does not need side push from the inclined plate 34 (the bit 36 is fully engaged in the formation 30), the main BHA 20 can be moved down slowly as the bit 36 is now self guided in the lateral 50. Obviously the down movement of the main BHA 20 is limited to the upper end of the collar groove 32. It should also be noted that if the side wall of the collar groove 32 is relieved, the main BHA 20 can also be slightly oscillated right and left (typically 45 degrees). Drilling fluid flows through the main BHA bit (not shown), so that good circulation is can be ensured over the whole length of the main well 24. This also plays a role for limiting the risk of stuck pipe. This circulation plays also a role to lift the cutting generated tin the lateral up to the surface.

In the small lateral, the drilling fluid circulation velocity is maintained at an appropriate rate to lift the cuttings over the length of the lateral up to the main well. The small BHA may also be move up and down for cutting clean-up and limiting the risk of stuck pipe in the lateral.

If the small BHA is stuck in the lateral, the main BHA can then be pulled upwards to shear the small BHA at the junction between the main and lateral wells. This allows freeing the main BHA, limiting the loss.

The small BHA can support various types of measurements (such as direction and inclination, local resistivity, cross-well resistivity, cross-well sonic, etc.)

With some design modifications, the small BHA can be fished with a slick-line through the main drill string. The fishable plug 60 (FIG. 6) around the bottom of the small BHA allows all parts from the bit to the flow flap valves and control unit to be fished. The ability to fish the small BHA allows replacement of broken small BHA or opening of the window for installation of other tools in the lateral. These other tools can be mechanical or electrical. They can be lowered via slick-line or wireline cable. Some of these tools allows technical intervention in the lateral (such as placement of simplified completion) or logging in the small lateral via slim wireline tool).

Figure 17:
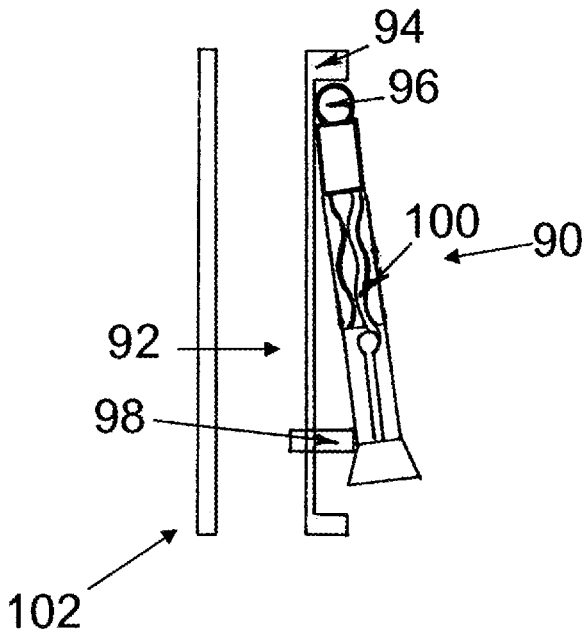
FIG. 17 shows a fifth embodiment of an apparatus according to the invention.

FIG. 17 shows a further embodiment of the invention with a simplified design. The small BHA 90 is contained in an external groove 92 of the drill collar 94 and connected by means of a hinge 96. The small BHA 90 is also flexible. When a lateral is to be drilled, a mechanical control mechanism 98 pushes the front of the small BHA 90 to the outside. At the same time drilling fluid flow is commences through the small motor 100. As the small BHA 90 starts to enter in the formation, main BHA 102 is slowly moved forwards ensuring displacement of the small BHA 90 into the formation. If the small BHA 90 is equipped with a bend housing, the lateral will be steered away from the main well.

A further embodiment of the invention use a crawler or tractor in the main BHA to advance the small BHA. This system can be operated from a wireline cable inside the main drill string. The control unit directs the drilling fluid flow to wards the small BHA. Such as system is flexible as it can move over long distance. As an alternative to an electrical control unity, it could also be based on MWD and rotary steerable systems technology. When a wireline cable is used, the cable (and optionally, the control unit) is lowered prior to the lateral drilling and retrieved at the end of the operation.

Variants of dual BHA systems described above can be used in cased wells. In this application, the main BHA bit is then replace by a window milling bit (and whipstock).

Another embodiment comprises two small BHAs, one with a milling bit, the other with a drilling bit. The setting of the control unit is slightly more complex, to avoid confusion between the setting of the two small BHAs. In fact, such a system has three potential bits to deploy:

a) Both small BHA retracted, drilling/milling with bit on main BHA;

b) Top small BHA in drilling mode, bottom retracted; and c) Top small BHA retracted, bottom small BHA in milling mode.

Figure 2:
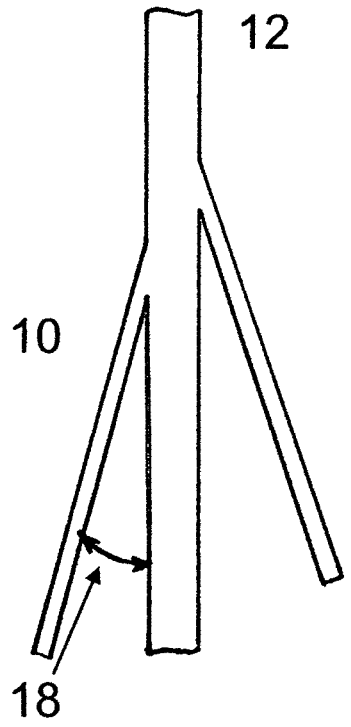

The lateral may have more complex shape than shown in FIGS. 1 and 2. In one embodiment, this is achieved mechanically, for example via special shape of the groove which guide the key of the reaction torque extension.

Figure 18:
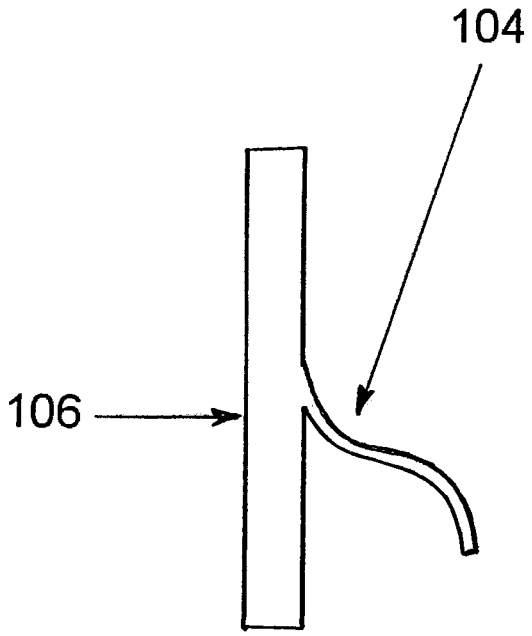
FIGS. 18 and 19 show well trajectories drilled with an apparatus according to the invention.

For some field applications, the lateral 104 may need to have a S-shape as is shown in FIG. 18. This ensures that the end of the lateral is nearly parallel to the main well 106. To provide this trajectory, the tool face of the small BHA is rotated by 180 degrees at the middle of the displacement. The motor reaction is transmitted to the collar via the upper "reaction" torque extension and the key groove makes a 180 degree spiral in the collar. When the key from the "reaction" torque extension reaches this position the small BHA is forced to make a half turn on itself. The pitch of the spiral is preferably extended over a distance of a few meters to avoid high twisting of the bend housing at the other extremity of the small BHA.

Figure 19:
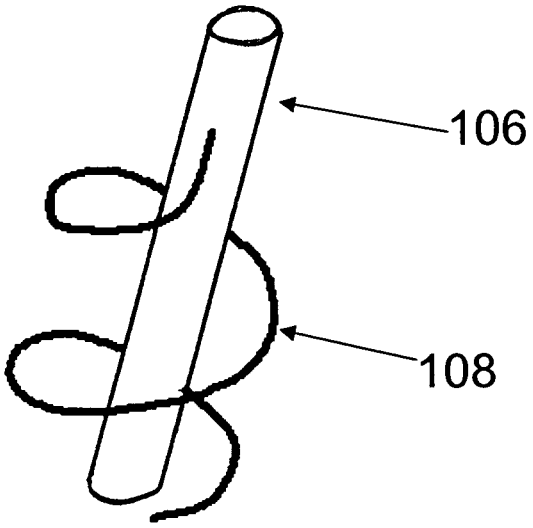

For other applications, it may be beneficial to drill corkscrew shape lateral 108 around the main well 106 as is shown in FIG. 19. To achieve this pattern, the bend housing azimuth is continuously adjusted to steer the motor away from its current plane. To achieve this tool-face setting, the key groove which guides the reaction torque key of the "reaction" torque extension is provided with an appropriate spiral. For example, the lateral can be drilled on a "cylindrical surface" which has a radius of 5 meters with a pitch of 15 meters. This means that the well is inclined at 45 degrees relative to the main well. Each rotation needs a displacement of approximately 21 meters and the laterals can make two turns.

The invention claimed is:

1. A drilling apparatus, comprising:

a drill collar forming part of a primary drilling assembly and having an outward opening groove in the side thereof; and a secondary drilling assembly, comprising:

a piston slidably mounted in the drill collar, the piston comprising a bypass to allow fluid to pass along the drill collar without moving the piston;

a tubular drill string connected at one end to the piston;

a drilling motor mounted in the drill string, the drilling motor comprising a regulator that controls the opening of the bypass according to motor speed; and a drill bit mounted at the other end of the drill string and connected to the drilling motor;

wherein the secondary drilling assembly is mounted in the drill collar so as to be movable between a first position in which the drill bit is seated in the groove, and a second position in which the drill bit projects laterally from the groove in the side of the drill collar.

2. The drilling apparatus of claim 1, wherein the groove has an inclined lower end sloping up to the outer surface of the drill collar.

3. The drilling apparatus of claim 1, wherein the groove is referenced to the tool face of a drilling tool connected to the drill collar such that orienting the tool face in a particular direction serves to orient the groove in a corresponding manner.

4. The drilling apparatus of claim 1 wherein the drill collar has a sliding shutter that is moveable between a first position in which the groove is covered, and a second position in which the groove is open.

5. The drilling apparatus of claim 1 further comprising a retraction system for moving the secondary drilling assembly from the second position to the first position.

6. The drilling apparatus of claim 1 wherein the groove comprises a sliding seal through which the drill string projects when the secondary drilling assembly is moved into its second position.

7. The drilling apparatus of claim 1 further comprising a transmission shaft extending through the drill string to connect the drill bit to the drilling motor.

8. The drilling apparatus of claim 7, wherein the drill bit comprises a bearing housing including the connection between the drill bit and the transmission shaft.

9. The drilling apparatus of claim 8, wherein the bearing housing also comprises a bent housing.

10. The drilling apparatus of claim 8, wherein the bearing housing contains measurement devices.

11. The drilling apparatus of claim 1 wherein the drilling motor comprises a siren including a stator connected to the piston and a rotor mounted adjacent the stator and connected to the drill bit.

12. The drilling apparatus of claim 11, wherein the rotor is connected to the drill bit via a torsion spring.

13. The drilling apparatus of claim 11, further comprising means to urge the rotor into an open position relative to the stator.

14. The drilling apparatus of claim 13, wherein the means comprise magnets on the rotor and stator.

15. The drilling apparatus of claim 11, comprising means for adjusting the angular position of the rotor and stator as the secondary drilling assembly moves towards the second position.

16. The drilling apparatus of claim 15, wherein the means comprises a groove in the drill collar defining a cam surface along which a rotor locating key slides as the secondary drilling assembly moves.

17. The drilling apparatus of claim 11, further comprising a pressure detector for detecting pressure pulses created by operation of the siren and creating a signal, and a control system for using the signal to control operation of the secondary drilling assembly.

18. The drilling apparatus of claim 1 wherein the drill collar includes an operable clamping device that can act on the secondary drilling assembly such that operation of the device to clamp the secondary drilling assembly to the drill collar allows movement of the drill collar to move the secondary drilling assembly and operation of the device to release the secondary drilling assembly allows independent movement of the primary and secondary drilling assemblies.

19. The drilling apparatus of claim 18, wherein the clamping device comprises a pair of pivoted eccentric bodies acting on the secondary drilling assembly.

20. The drilling apparatus of claim 1 further comprising means for resisting torque resulting from operation of the secondary drilling assembly.

21. The drilling apparatus of claim 20, wherein the means comprises an elongate key on the drill string which engages in a corresponding groove in the drill collar.

22. The drilling apparatus of claim 21, wherein the means comprises an extension of the drill string above the drilling motor, the extension comprising an elongate key on the drill string which engages in a corresponding groove in the drill collar.

23. The drilling apparatus of claim 20, wherein the means comprises a drill string having a non-circular section which slides through a correspondingly shaped seal.

24. The drilling apparatus of claim 1 further comprising an attachment point on the secondary drilling assembly for connection of a retrieval line to move the secondary drilling assembly from the second position to the first position.

25. The drilling apparatus of claim 1 further comprising a secondary piston bypass and valve arrangement operable to direct fluid flow in the drill collar to the underside of the piston to move the secondary drilling assembly from the second position to the first position.

26. The drilling apparatus of claim 1, further comprising a control mechanism operable to force the secondary drilling assembly out of the groove.

27. The drilling apparatus of claim 26, wherein the secondary drilling assembly is connected to the drill collar by a hinge.

28. The drilling apparatus of claim 26, wherein the drill string is flexible.

29. The drilling apparatus of claim 1, wherein the primary drilling assembly is configured to drill a window in well casing through which the secondary drilling assembly can be advanced.

30. A method of drilling a borehole, comprising:

using a drilling apparatus comprising:

a drill collar forming part of a primary drilling assembly and having an outward opening groove in the side thereof; and a secondary drilling assembly, comprising:

a tubular drill string connected at one end to the drill collar;

a drilling motor mounted in the drill string; and a drill bit mounted at the other end of the drill string and connected to the drilling motor;

wherein the secondary drilling assembly is mounted in the drill collar so as to be movable between a first position in which the drill bit is seated in the groove, and a second position in which the bit projects laterally from the groove in the side of the drill collar;

drilling a main borehole; positioning the apparatus at a predetermined location in the main borehole;

operating the secondary drilling assembly so as to advance the drill bit away from the first position and drill laterally into the formation surrounding the main borehole and form a lateral borehole;

advancing the drill collar while the secondary drilling assembly is drilling into the formation; and withdrawing the secondary drilling assembly to the first position.

31. The method of claim 30, wherein the secondary drilling assembly comprises a crawler device located in the drill collar, the tubular drill string being connected at one end to the crawler device and extending inside the drill collar; wherein, during movement between the first position and the second position, the crawler device is advanced in the drill collar.

32. The method of claim 30, comprising using the primary drilling assembly to drill the main borehole.

33. The method of claim 30, further comprising alternately advancing and retracting the drill collar over a short distance in the main borehole while the secondary drilling assembly is drilling into the formation.

34. The method of claim 30, wherein the main well has been lined with casing, the method comprising opening a window in the casing using the primary drilling assembly prior to operating the secondary drilling assembly to drill through the window into the formation.

35. The method of claim 30, comprising using the secondary drilling assembly to drill a lateral borehole with an S-shape or with a spiral trajectory.

36. A drilling apparatus, comprising:

a drill collar forming part of a primary drilling assembly and having an outward opening groove in the side thereof; and a secondary drilling assembly, comprising:

a tubular drill string connected at one end to the drill collar;

a drilling motor mounted in the drill string, the drilling motor comprising a siren including a stator connected to a piston and a rotor mounted adjacent the stator and connected to the drill bit;

means to urge the rotor into an open position relative to the stator, wherein the means comprise magnets on the rotor and the stator; and a drill bit mounted at the other end of the drill string and connected to the drilling motor;

wherein the secondary drilling assembly is mounted in the drill collar so as to be movable between a first position in which the drill bit is seated in the groove, and a second position in which the drill bit projects laterally from the groove in the side of the drill collar.

37. The drilling assembly as claimed in claim 36, wherein the secondary drilling assembly comprises a crawler device located in the drill collar, the tubular drill string being connected at one end to the crawler device and extending inside the drill collar; wherein, during movement between the first position and the second position, the crawler device is advanced in the drill collar.

38. A drilling apparatus, comprising:

a drill collar forming part of a primary drilling assembly and having an outward opening groove in the side thereof; and a secondary drilling assembly, comprising:

a tubular drill string connected at one end to the drilling collar;

a drilling motor mounted in the drill string, the drilling motor comprising a siren including a stator connected to the piston and a rotor mounted adjacent the stator and connected to the drill bit;

means for adjusting the angular position of the rotor and stator as the secondary drilling assembly moves toward the second position, the means comprising a groove in the drill collar defining a cam surface along which a rotor locating key slides as the secondary drilling assembly moves; and a drill bit mounted at the other end of the drill string and connected to the drilling motor;

wherein the secondary drilling assembly is mounted in the drill collar so as to be movable between a first position in which the drill bit is seated in the groove, and a second position in which the drill bit projects laterally from the groove in the side of the drill collar.

39. The drilling assembly as claimed in claim 38, wherein the secondary drilling assembly comprises a crawler device located in the drill collar, the tubular drill string being connected at one end to the crawler device and extending inside the drill collar; wherein, during movement between the first position and the second position, the crawler device is advanced in the drill collar.

* * * * *